US009719527B2

(12) United States Patent
Mitsch

(10) Patent No.: US 9,719,527 B2
(45) Date of Patent: Aug. 1, 2017

(54) SHRED AND SHEAR PUMP

(71) Applicants: BJM CORPORATION, Old Saybrook, CT (US); Brian M. Mitsch, Bradford, OH (US)

(72) Inventor: Brian M. Mitsch, Bradford, OH (US)

(73) Assignee: BJM Pumps, LLC, Old Saybrook, CT (US)

( * ) Notice: Subject to any disclaimer, the term of this patent is extended or adjusted under 35 U.S.C. 154(b) by 0 days.

(21) Appl. No.: 14/765,327

(22) PCT Filed: Jul. 31, 2014

(86) PCT No.: PCT/US2014/049318

§ 371 (c)(1),
(2) Date: Jul. 31, 2015

(87) PCT Pub. No.: WO2015/017740

PCT Pub. Date: Feb. 5, 2015

(65) Prior Publication Data

US 2015/0377255 A1 Dec. 31, 2015

Related U.S. Application Data

(60) Provisional application No. 61/861,365, filed on Aug. 1, 2013.

(51) Int. Cl.
*F04D 29/70* (2006.01)
*F04D 7/04* (2006.01)
(Continued)

(52) U.S. Cl.
CPC ..... *F04D 29/708* (2013.01); *F04D 1/00* (2013.01); *F04D 7/045* (2013.01); *F04D 13/02* (2013.01);
(Continued)

(58) Field of Classification Search
CPC . F04D 1/00; F04D 7/045; F04D 13/02; F04D 29/22; F04D 29/2288; F04D 29/24; F04D 29/426; F04D 29/428; F04D 29/708
See application file for complete search history.

(56) References Cited

U.S. PATENT DOCUMENTS 4,378,093 A * 3/1983 Keener ..... F04D 7/045 241/46.017
5,016,825 A * 5/1991 Carpenter ..... F04D 29/2288 241/258
(Continued)

FOREIGN PATENT DOCUMENTS

KR 10-0918876 B1 * 9/2009 ..... F04D 7/045
KR 10-0918876 B1 9/2009
(Continued)

*Primary Examiner* — Woody Lee, Jr.
(74) *Attorney, Agent, or Firm* — Damian Wasserbauer, Esq.; Wasserbauer Law LLC

(57) ABSTRACT

The present invention is a pump used for applications where a solid is present in wastewater and other liquids that requires cutting and reduction in size so as to pass the solid through the inlet to the outlet of the pump. The pump has a pump casing with an inlet and an outlet formed therein. A drive unit rotates a drive shaft extending axially through the pump casing to an impeller and a cutter bar. The pump is further configured with a radial cutter ring assembly positioned adjacent the cutter bar and the inlet providing a shredding cutting action of solids between the rotating cutter bar sliding past a radial cutter ring assembly held stationary, e.g. cutting blades formed in an edge of the cutter bar rotate across an internal surface of the radial cutter ring assembly. The pump also has an axial cutter ring assembly with one or more blades forming openings adapted for the passage of solids from the inlet to the outlet to provide a shearing cutting action of solids by a rotation of an upper surface of the cutter bar sliding past an axial cutting surface of the
(Continued)

blades of the axial cutter ring assembly. The shred and shear pump may be configured with a plurality of slots on the internal surface of the radial cutter ring assembly to hold woven fibrous material for the shredding cutting action. The pump also features improved optimized flow, cutting and reducing solids in the form of woven fibrous materials, and adjustability of the cutter housing for precision and wear adjustment.

10 Claims, 6 Drawing Sheets

(51) Int. Cl.

| | |
|---|---|
| ***F04D 13/08*** | (2006.01) |
| ***F04D 29/22*** | (2006.01) |
| ***F04D 29/24*** | (2006.01) |
| ***F04D 1/00*** | (2006.01) |
| ***F04D 13/02*** | (2006.01) |
| ***F04D 29/42*** | (2006.01) |
| ***F04D 29/44*** | (2006.01) |

(52) U.S. Cl.
CPC ..... *F04D 13/086* (2013.01); *F04D 29/22* (2013.01); *F04D 29/2288* (2013.01); *F04D 29/24* (2013.01); *F04D 29/426* (2013.01); *F04D 29/448* (2013.01)

(56) References Cited

U.S. PATENT DOCUMENTS

| | | | | |
|---|---|---|---|---|
| 7,237,736 | B1 * | 7/2007 | Martin | F04D 7/045 241/185.6 |
| 7,841,827 | B2 * | 11/2010 | Keener | F04D 29/2288 415/121.1 |
| 8,784,038 | B2 * | 7/2014 | Ciotola | B02C 18/0092 241/21 |
| 2010/0003124 | A1 * | 1/2010 | Wagner | F04D 7/045 415/121.1 |

FOREIGN PATENT DOCUMENTS

| | | | | |
|---|---|---|---|---|
| KR | 10-1036955 | B1 * | 5/2011 | F04D 7/045 |
| KR | 10-1036955 | BI | 5/2011 | |

* cited by examiner

SHRED AND SHEAR PUMP

This patent application claims priority to U.S. Provisional Patent Application Ser. No. 61/861,365 entitled "SHRED AND SHEAR CENTRIFUGAL PUMP" filed on Aug. 1, 2013, and the entire disclosure is hereby incorporated by reference herein.

FIELD OF THE INVENTION

The present invention is in the field of pumps capable of shearing and shredding solids at the intake of portion of the pump for numerous applications including wastewater, sewage, sewerage, industrial, and agriculture.

BACKGROUND OF THE INVENTION

A variety of pumps are known currently for pumping liquids, wastewater, and other liquids containing solids such as garbage, disposable products, woven fabrics, poly-materials, and other items. While these pumps can chop solids to varying degrees to permit solids to flow through to the output of the pump for disposal, other problems occur because modern wastewater contains solids in the form of synthetic disposable products and woven fibrous materials. Conventional pump designs do a poor job of shredding such solids and woven fibrous materials.

In order to process solids conventional pumps generally employ a non-clog style impeller design to suck the solids into the pump. When solids are woven fibrous materials, these solids are not sheared into a passable sized solid by the non-clog style impeller when initially entering the pump. Typically, woven fibrous materials become balled around the eye of the impeller due to the water and impeller rotation. Once balled, woven fibrous materials often fail to pass out of the pump, reduce the pump output flow, and can result in pump failure such as, for example, clogging, seizing and motor burnout.

Conventional chop or chopper pump designs typically use a centrifugal pump equipped with a cutting system to facilitate the chopping and maceration action of solids that are present in the pumped liquid, whereby a drive unit (e.g. electric motor, hydraulic motor, etc.) turns an impeller and the cutting system. The impeller is fixedly mounted to a drive shaft of the drive unit. When such solids enter the inlet, the impeller has sharpened shroud edges adapted for cutting the solids against spiral grooves in a back plate. Chopper pumps are available in various configurations and are typically equipped with an electric motor to run the impeller and provide torque for the chopping system. Existing chopper pump designs have disadvantages in processing solids of woven fibrous materials including clogging, wrapping or stoppage of the pump operation because once the solids have entered the impeller, these solids must travel across to the back plate before the cutting action, whereby wrapping can occur before cutting. It would be an improvement over conventional chopper pump designs to prevent clogging of the pump itself and of the adjacent piping by such solids and woven fibrous materials.

In conventional grinder pump designs the impeller or grinder is positioned at the intake portion of the pump so as to use the impeller as part of the cutting mechanism. Existing grinder pump designs have disadvantages including not allowing solids to gain entry until sliced into smaller particles, i.e. in an all-or-nothing action relying on the solids being cut or kicked-out before being sucked back to the impeller for another try. The kick-out action of solids and woven fibrous materials in conventional grinder pump designs is often unsuccessful and less than optimal. Wrapping and clogging can still occur even after multiple kick-out actions of the solids because woven fibrous materials accumulate to eventually clog the pump intake that can leading to pump failure (e.g. burnout). A common solution is to use higher capacity pumps with larger motors and intake openings (i.e., increase in the size of the pump) in order to allow passage of solids a relatively large diameter intake. However, over-sizing the pump to increase pump intake also results in a cost increase in the pump needed for the application.

Consequently there is a long-felt need for an cost effective, optimally-sized pump configured to overcome the numerous problems associated with woven fibrous materials and other disadvantages of the prior art. The present invention provides a durable centrifugal pump effective for pumping solids and woven fibrous materials suspended in a liquid in an effective smaller pump design. The shear and shred pump design of the present invention reduces clogging and failures in the operation of cutting, shearing, or shredding of solids, and especially woven fibrous materials, present at the pump intake. The shear and shred pump design of the present invention also provides an improved centrifugal pump in a smaller design where a larger pumps heretofore have been used. Consequently, there is a long-felt need for a pump having an improved cutting action for use in applications where a smaller design is suitable to process modern wastewater and in other liquid processing applications.

SUMMARY OF THE INVENTION

The present invention is a shred and shear pump configured with a pump casing with an inlet and an outlet formed therein. A drive unit rotates a drive shaft extending axially through the pump casing to an impeller and a cutter bar. The pump is further configured with a radial cutter ring assembly positioned adjacent the cutter bar and the inlet providing a shredding cutting action of solids between the rotating cutter bar sliding past a radial cutter ring assembly held stationary, e.g. cutting blades formed in an edge of the cutter bar rotate across an internal surface of the radial cutter ring assembly. The pump also has an axial cutter ring assembly with one or more blades forming openings adapted for the passage of solids from the inlet to the outlet to provide a shearing cutting action of solids by a rotation of an upper surface of the cutter bar sliding past a surface of the one or more blades of the axial cutter ring assembly. The shred and shear pump may be configured with one or more slots on the internal surface of the radial cutter ring assembly to hold woven fibrous material for the shredding cutting action.

The cutter bar can be configured with a rounded surface opposite the upper surface of the cutter bar adapted to provide an eject or kick-out action of solids and woven fibrous materials of a predetermined dimension larger than the openings in the axial cutter ring assembly.

The one or more blades of the axial cutter ring assembly may be configured at an angle sufficient to cut solids and woven fibrous materials of a predetermined dimension entering the openings in the axial cutter ring assembly.

The shred and shear pump of the present invention may be formed with an adjustable interface between the surface of the axial cutter ring and the cutter bar to allow for optimal shearing cutting action when new and for adjustments later to maintain optimal shearing cutting action after some wear has occurred (i.e., to adjust the gap between cutter bar and axial cutter ring assembly to compensate for wear, thereby allowing for a longer service of the pump).

The edge of the cutter bar may be formed with cutting blades (i.e. one or more grooves, teeth, or serrations) sufficient to shred, and otherwise cut solids, and especially woven fibrous materials, held in the plurality of slots of the radial cutter ring assembly.

The openings formed by the one or more blades of the axial cutter ring assembly are configured so as improve liquid Flow F and the passage of solids from the inlet to the outlet of a smaller profile shred and shear pump so as to perform in applications where larger non-clog wastewater pump are currently utilized.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of the Embodiments, which is to be read in association with the accompanying drawings, which are incorporated in and constitute a part of this specification, show certain aspects of the subject matter disclosed herein and, together with the description, help explain some of the principles associated with the disclosed implementations, wherein.

DESCRIPTION OF THE EMBODIMENTS

Figure 1:
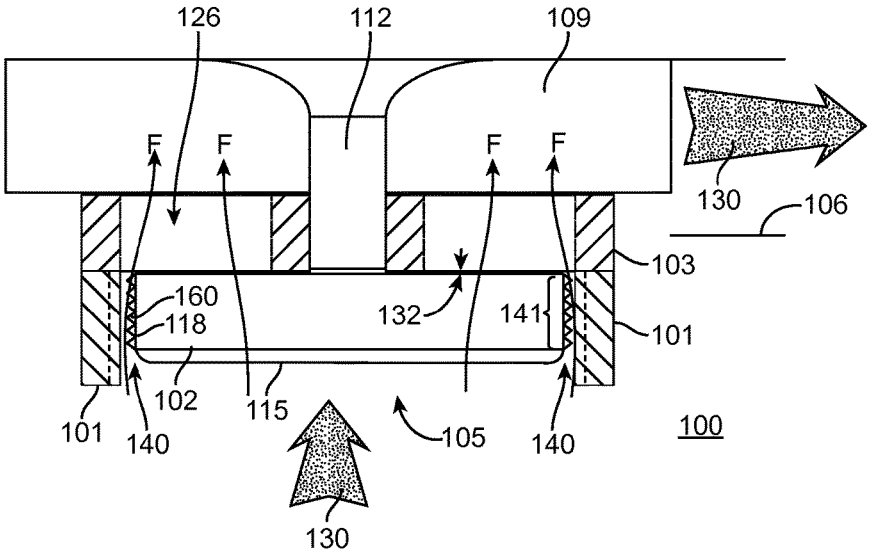
FIG. 1 illustrates a schematic of the radial cutter ring, cutter bar and axial cutter ring assembly between the inlet and outlet of the pump, with a cross sectional view taken along lines A-A of FIG. 4, according an embodiment of the present invention.

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "centrifugal" and "centrifugal pump" refers to class of pumps with dynamic axis-symmetric function used to transport liquids by the conversion of rotational kinetic energy to the hydrodynamic energy of the liquid flow. The rotational energy typically comes from an engine or electric motor, whereby liquid enters the pump impeller along or near to the rotating axis and is accelerated by the impeller, flowing radially outward into a diffuser or volute chamber (casing), from where it exits. According to embodiments of the present invention, centrifugal pumps are useful in water, sewage, petroleum and petrochemical pumping applications.

As used herein the term "chop" or "chopping" refers to the ability of a blade to cut arising from the concentration of the force applied to the blade onto a very small area, resulting in a high pressure on the matter to be penetrated. A blade is that portion of a tool or machine with an edge that is designed to cut and/or puncture, stab, slash, chop, slice, thrust, or scrape surfaces or materials.

As used herein the term "fibrous", "woven", "woven-material", and "woven fibrous material" refers to natural fibers, man-made materials such as synthetic, bio-degradable polymers, super-absorbent material from polymers known as sodium polyacrylate or other human-made polymers, or a combination of both. Examples of woven fibrous material and solids in the wastewater or liquid being pumped range from fabrics and household products (wipes, cloths, scrubbers, etc.) to toilet products (diapers, feminine products, baby wipes, etc.). Modern sewage wastewater contains these woven fibrous materials and these clog and stop known centrifugal pumps because of the poly-stranded fabrics. Large pumps pass such fibrous materials because of the large inlet and outlet dimensions.

As used herein the term "solid" or "solids" refers to any organic and inorganic solid materials. Organic solids are solids such as, for example, feces, hair, food, paper fibers, plant material, humus, food particles, etc. Inorganic solids are solids such as, for example, sand, grit, metal particles, ceramics, etc. Other inorganic macro-solids are solids including woven fabric materials such as, for example, sanitary napkins, nappies/diapers, condoms, needles, children's toys, dead animals or plants, etc.

As used herein the term "pump" refers to a device that moves liquids (liquids or gases), or sometimes slurries, by mechanical action. According to embodiments of the present invention, pumps include the centrifugal mechanical pumps useful in a wide range of applications such as pumping liquids and wastewater from holding tanks to another location as desired.

As used herein the term "shear" refers to the cutting and the deformation of a material substance in which parallel internal surfaces slide past one another. For example, scissors are used in clothing manufacture to cut fabric on the shear.

As used herein the term "shearing cutting action" refers to the ability of the blades of the pump device to cut solids and materials by a shearing action.

As used herein the term "shred" refers to the action of a device, usually electrically powered, that shreds solids and other materials suspended in a liquid (i.e., food waste, woven fabric material, etc.) into pieces small enough to pass through a pipes, outlets, plumbing and the like.

As used herein the term "shredding cutting action" refers to the ability of the blades of the pump device to cut solids and materials by a shredding action.

As used herein the term "wastewater" refers to sewage, sewerage, wastewater and any water that has been adversely affected in quality by anthropogenic influence. Municipal wastewater is usually conveyed in a combined sewer or sanitary sewer, and treated at a wastewater treatment plant or wastewaters generated in areas (i.e. campsites, subdivisions, homes, etc.) without access to centralized sewer systems rely on pumping to sewage treatment, and on-site wastewater systems such as, for example, a septic tank, drain field, and optionally an on-site treatment unit. Sewage includes domestic, municipal, or industrial liquid waste products disposed of, usually via a pipe or sewer (sanitary or combined), sometimes in a cesspool emptier. Sewerage is the physical infrastructure (e.g. pipes, pumps, screens, channels etc.) used to convey sewage from its origin to the point of eventual treatment or disposal.

As is illustrated in FIGS. 1 through 11, an apparatus, system and method for a shred and shear pump 100 with improved cutting action of solids 130, especially woven fabric materials, is described according to an embodiment of the present invention in a semi-closed submersible centrifugal pump in a sewage application. According to an embodiment of the present invention, a shredding cutting action 140 and a shearing cutting action 150 can occur simultaneously and independently in the pump 100. For ease of describing these cutting actions the description of this embodiment differentiates into (1) solids 145 cut by the shredding cutting action 140; and (2) solids 155 cut by the shearing cutting action 150 in a Flow F path of solids generally suspended in a liquid through the pump 100 from an intake or inlet port 105 to an outlet port 106.

Figure 11:
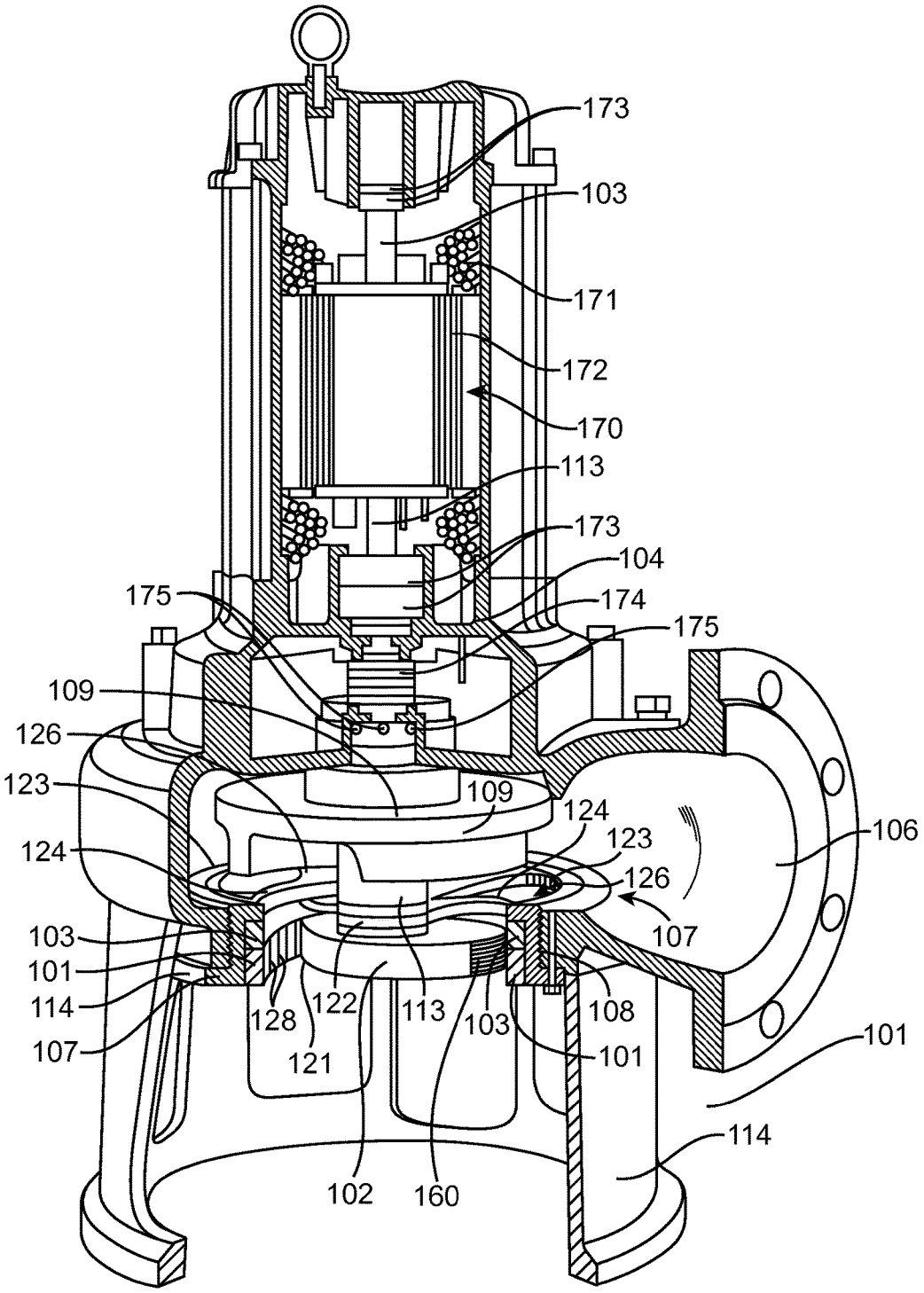
FIG. 11 illustrates a schematic cross sectional view the shred and shear centrifugal pump, with a cross sectional view taken along lines B-B of FIG. 10, according to an embodiment of the present invention.

It is to be appreciated that the multiple cutting action design of the present invention can be incorporated in various configurations of pumps, including non-clogging style impellers and closed, semi-open and vortex style impellers as used in a variety of applications, for example, as used in submersible pumps elevated off of the bottom of a tank by a stand, as is illustrated in FIG. 11, for discharge by an outlet pipe connected to an outlet of the pump. It is also contemplated that the multiple cutting action design of the present invention can be incorporated in various configurations of in-line pumps, for example, pumps having an inlet pipe connected to the reservoir sucking wastewater containing solids from the reservoir to the pump for discharge by an outlet pipe connected to an outlet of the pump. Moreover, the design of the present invention can be adapted from a semi-open, non-clog impeller of the design described herein to close and vortex impellers with minimal changes and/or experimentation.

As is illustrated in FIGS. 1-3, 10 and 11, the multi-cutting action centrifugal pump 100 generally includes a radial cutter ring assembly 101, a cutter bar 102, and an axial cutter ring assembly 103. The cutting action, simplified in FIG. 1 for illustration, includes a shredding cutting action 140 of solids occurs between the rotating cutter bar 102 sliding past a radial cutter ring assembly 101 held stationary, whereby one or more teeth of the cutter blade 160 formed on an edge 118 of the cutter bar 102 cooperate during the rotation with an internal surface 121 and/or slots 128 of the radial cutter ring assembly 101. The shredding cutting action 140 is provided by of the cutter blades 160 of the cutter bar 102 rotating across a radial cutting surface 141 formed by the parallel internal surfaces of the cutter blade 160 on edge 118 of the cutter bar 102 and an radial cutter ring surface 121 of the radial cutter ring assembly 101. The shearing cutting action 150 is provided by the rotation of the cutter bar 102 across an axial cutter ring assembly 103 as the parallel upper surface 116 and internal surface 153 of blades 124 slide past one another. The pump 100 is configured to utilize aspects of the cutter bar 102, the radial cutting ring assembly 101, and axial cutter ring assembly 103 by multiple cut, shear and shred actions thereof, respectively, so as to reduce the size of larger solids to allow passage through the pump and piping system through the use of a smaller pump.

Figure 2:
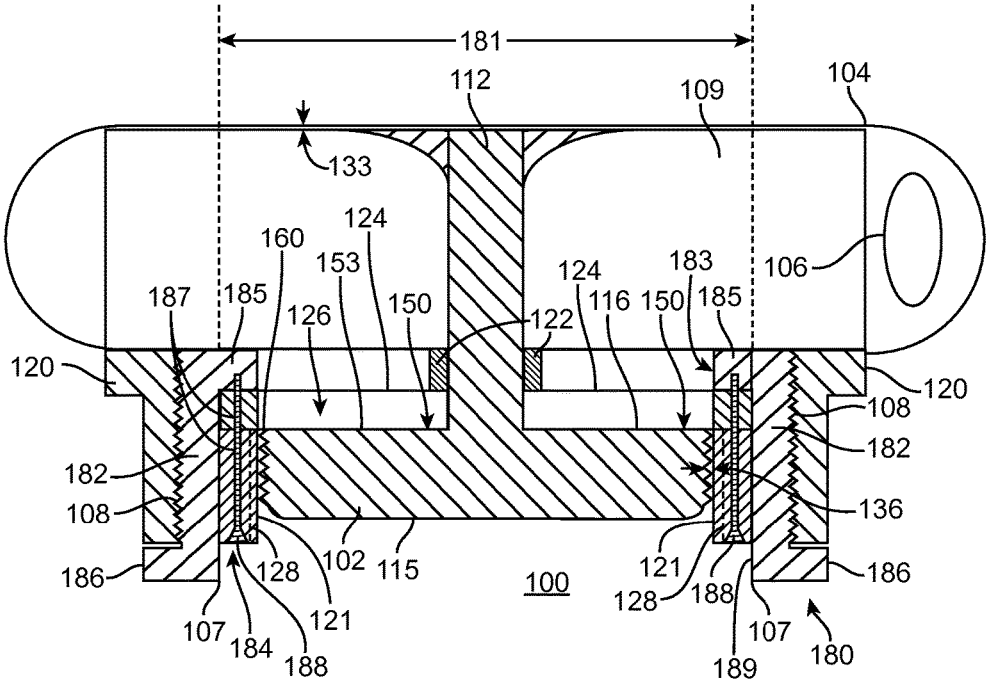
FIG. 2 illustrates a schematic of the cutter and pump housings of the pump, with a cross sectional view taken along lines A-A of FIG. 4, according an embodiment of the present invention.
Figure 3:
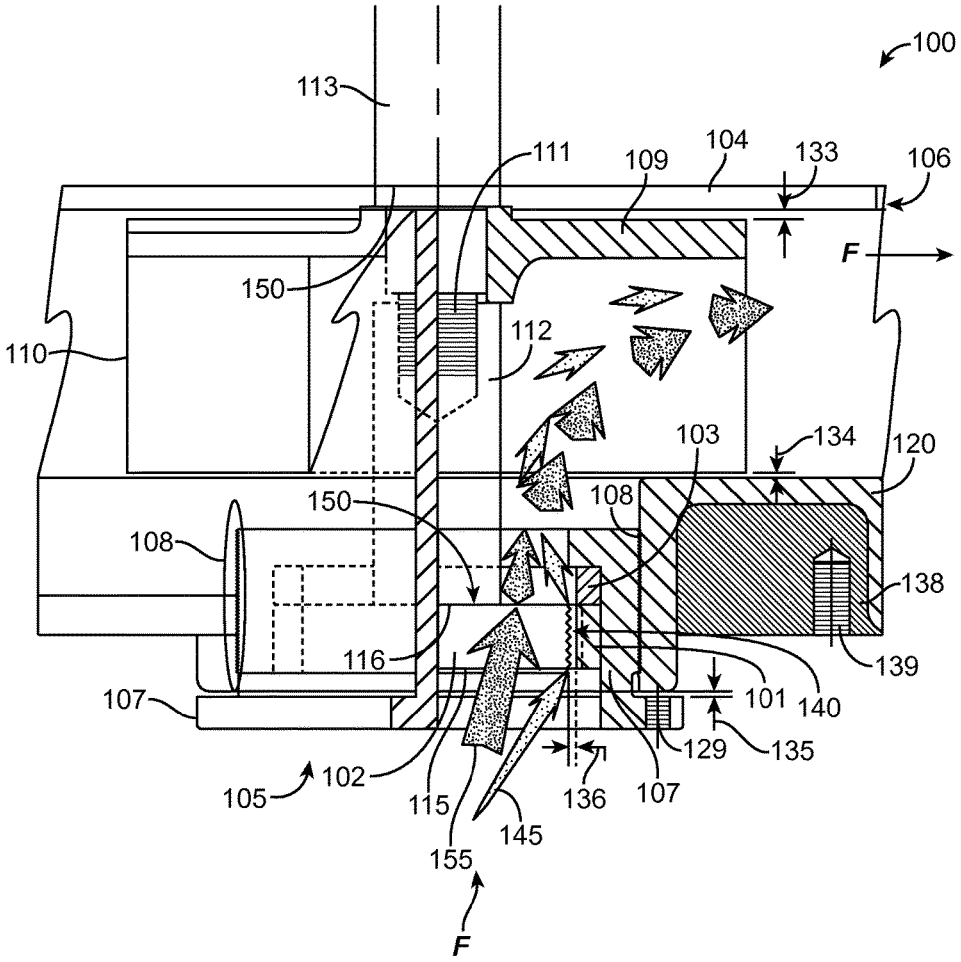
FIG. 3 illustrates a schematic, partial axial section of a cutting and shearing pump, with a cross sectional view taken along lines B-B of FIG. 10, according an embodiment of the apparatus, system, and method of the present invention.

As is illustrated in the schematic diagram of FIGS. 2, 3, and 11, the multi-cutting action pump 100 can be a centrifugal pump generally configured with a pump casing or housing 104 with an intake or inlet port 105 and an outlet or output port 106. The pump 100 is configured with the cutting assembly 180 having a generally cylindrical shaped cutter housing 107 with a predetermined diameter 181 to receive the axial cutter ring assembly 103 and radial cutter ring assembly 101. The cutter housing 107 has a side wall 182 and open ends 183, 184. The side wall 182 further comprises a cutter flange 185 located at one end 183 extending inwardly from the side wall 182 and a connecting flange 186 at an opposite end 184 extending outwardly from the side wall 182. The cutter and connecting flanges 185, 186 are adapted with one or more attachment points 187 for one or more fasteners 188 such as screws and bolts. The cutter flange 185 functions to hold stationary the radial cutter ring and the axial cutter assemblies 101, 103 to cutter housing 107. The cutter flange 186 functions to hold stationary dimension 132 using set screw 129 as adjusted by rotating cutter housing 107. The cutter assembly 180 can have the holes 187 counter-sunk so as to provide as smooth profile for layering the axial cutter ring assembly 103, radial cutter ring assembly 101 when secured to the cutter flange 185 of the housing 107 in the cutter assembly 180. The side wall 182 may be formed with a generally smooth inner surface 189 and a threaded outer surface 108 between said cutter and connecting flanges 185, 186 so as to be received by corresponding a treaded portion 108 of the pump casing 104 at the inlet 105 of the pump 100. The cutter housing 107 is adapted to receive the axial cutter ring assembly 103, radial cutter ring assembly 101 secured to the housing 107.

The housing 107 is configured and made adjustable relative to the cutter bar 102, pump casing 104, and suction cutter wear plate 120 by the threaded connection 108 so as to be configured by adjusting the cutter housing 107 to rotate the treaded connection 108 and then to secure by a locking fastener or set screw 129, whereby such adjustment can be performed easily and quickly and to these components in the field. Rotating the treaded connection 108 also adjusts relative to the suction cutter wear plate 120 so as to be adjustable when new and for wear over time. The cutter housing 107 is adapted receive and secure the axial cutter ring assembly 103, radial cutter ring assembly 101 to a cutter flange 185, with cutter bar 102 disposed within for positioning between inlet port 105 and an impeller 109.

Figure 10:
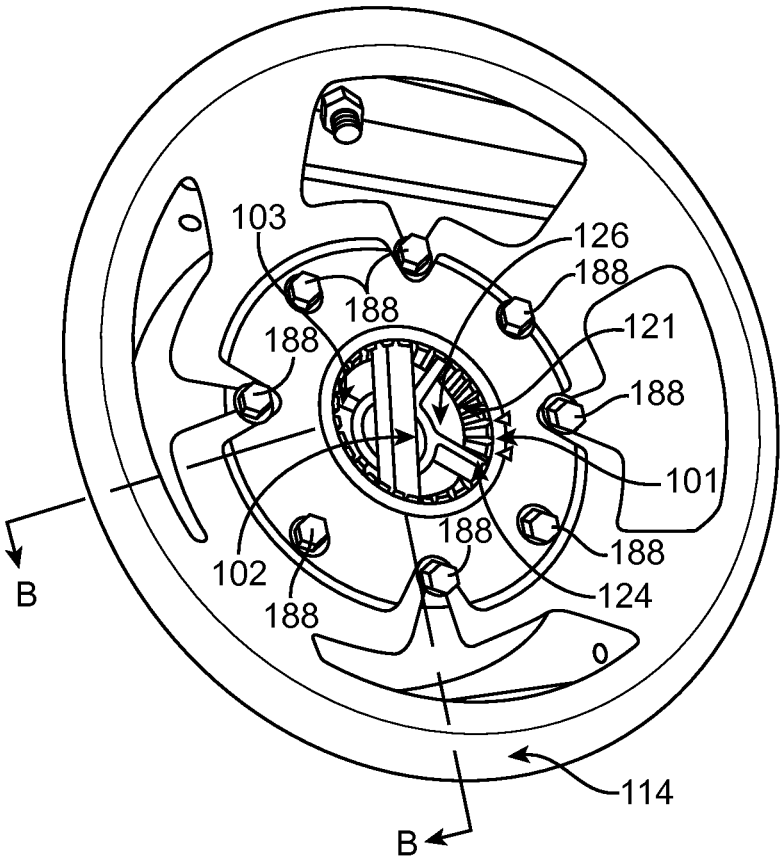
FIG. 10 illustrates an end view the dual cutting action shred and shear centrifugal pump according to an embodiment of the present invention.

As shown in FIGS. 2 and 10, the pump casing 104 can attach to a stand 114 to elevate off the bottom of the tank or enclosure by fasteners 188 such as screws and bolts. The impeller 109 is encased in the pump housing 104. A suction cutter wear plate 120 is arranged and held between the pump housing 104 and the stationary cutter housing 107. As is illustrated in FIGS. 2 and 3, the impeller 109 rotates freely within the pump housing 104 having a predetermined dimension 133 on one side and dimension 134 on the other side for clearance thereof.

As shown in FIG. 3, the shred and shear pump 100 may be formed with the adjustable cutter housing 107 to hold stationary the radial cutter ring assembly 101 and the axial cutter ring assembly 103 while allowing rotation of the cutter bar 102 to effectuate the shredding and shearing cutting actions 140 and 150. According to an embodiment of the present invention, fasteners 188 are used to hold stationary the radial cutter ring and the axial cutter assemblies 101, 103 to cutter housing 107; however, various other means and configurations can be used secure such the radial cutter ring and the axial cutter assemblies 101, 103 to the housing 107. The threaded connection 108 of the cutter housing 107 is adapted to vary, adjust and maintain dimension 132 (FIG. 2) of the axial cutting surface 153 of axial cutter ring assembly 103 and upper surface 116 of the cutter bar 102. The gap for the predetermined dimension 132 can be adjusted by rotating the treaded connection 108 of the cutter housing 107 and to fix or otherwise set in such dimension 132 with a locking fastener or set screw 129, which locks gap or dimension 135 (FIG. 3) between the cutter housing 107 and the suction plate 120 from further movement. For example, when new, and to compensate for wear over time, adjustments can be made to the cutter bar 102 and axial cutter ring assembly 103 and, in this manner, the design of the present invention provides for quick and easy adjustments so as to account for wear of parts. Moreover, the coordinated, multiple cutting and shearing actions in the pump can be maintained for improved durability, maintenance and life thereof.

As is illustrated in FIGS. 1 through 3, the pump 100 also has an inlet port 105 for the intake of solids including woven fibrous material suspended in a liquid processed by the shredding cutting action 140 and by the shearing cutting action 150 for outputting shredded and sheared solids 145, 155, respectively, to the outlet port 106. The Flow F from the inlet port 105 to the outlet port 106 is provided by the rotation of the impeller 109 and vanes 110 by the motor of the centrifugal pump 100. According to an embodiment of the present invention, the cutter bar 102 is affixed by a threaded connection 111 in the cutter bar shaft 112 to the drive shaft 113 of the drive unit or motor 170. In operation, the drive unit 170 rotates the impeller 109 disposed on the drive shaft 113. The vanes 110 of the impeller 109 impart force(s) upon the liquid by the rotation of the impeller 109 so as to draw, suck, and force solids to enter the inlet port 105 or otherwise the suction area of the pump 100. As shown in FIGS. 2, 10 and 11, the pump casing 104 further can include a stand mount 138 and or one or more connection(s) 139 adapted to secure to a pipe for pumping liquids in in-line applications or the stand 114 in submersible applications.

As is illustrated in FIGS. 1-4, and 5-11, a shearing cutting action 150 is performed between a surface 153 of a blade 124 of the axial cutter ring assembly 103 and an adjacent upper surface 116 of the cutter bar 102 during the rotation of the cutter bar 102. The shearing cutting action 150 also occurs to a lesser extend in other interactions with the cutting ring 121, inner ring 122, outer ring 123, and blades 124. The upper surface 116 of the cutter bar 102 is configured with flat, smooth surface and configured to have a predetermined dimension 132 (FIG. 1) between the upper surface 116 and the adjacent surface 153 of the axial cutter ring assembly 103 sufficient for the shearing cutting action 150, for example, a minimal tolerance of approximately 0.001" to 0.005" inches. The dimension 132 is made adjustable by the threaded connection 108 of the cutter housing 107 of the cutter assembly 180. Advantages of the present invention's design include improving the cutting and shearing of solids, especially woven fibrous materials.

Figure 9:
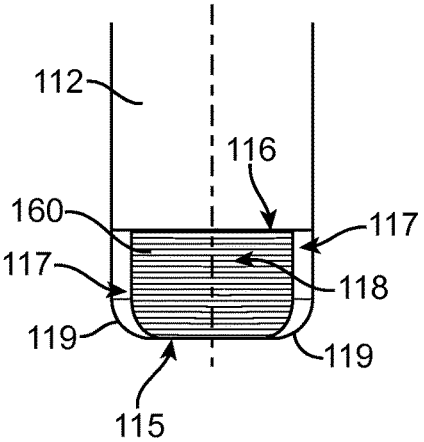
FIG. 9 illustrates an edge view grooved cutters on the edge of the cutter bar.

As is shown in FIGS. 3, 9 and 11, the lower surface 115 of the cutter bar 102 is configured with a curved, rounded or tapered edge 119. The curved edge 119 on the lower surface 115 provides a smooth surface that does not unduly impeding the Flow F of liquids to assist pump operation. The curved edge 119 imparts vector forces upon solids present in the liquid Flow F due to the rotation of the cutter bar 102. For example, a kick-out action to eject solids in the Flow F of the liquid that are too large for the inlet port 105 occurs from the center to about 45 degrees of the curve of edge 119. The remaining 45 degrees of the curve of edge 119 assists the shredding and shearing cutting actions 140, 150, respectively. For example, solids 130 are pushed from the center outwardly to coordinate (1) moving such solids 130 for the shredding cutting action 140 by the radial cutter ring assembly 101 and cutter bar 102; (2) moving such solids 130 for the shearing cutting action 150 by the cutter bar 102 and axial cutter ring assembly 103 and (3) directing such solids 130 into the Flow F to the inlet port 105. As a result, coordinating the shredding and shearing cutting actions 140, 150 with the curved edge 119 of the lower surface 115 is an improvement over prior art designs and for the cutting of solids and fibrous material. Advantages of the design the present invention include being able to use a smaller pump with the advantages of a larger centrifugal pump, and being able to use in many modern wastewater, industrial and liquid applications (e.g. schools, sports centers, shopping malls, aquariums, aquatic parks, airports, bus stations, trailer parks, research centers, hospitals, amusement parks, dairies, feed lots, food packaging, meat processors, bottling plants, camp grounds, industrial parts, spill containment, etc.). The design the present invention satisfies a long-felt need for smaller pumps in where solids are present in liquids to overcome the problems of clogging and pump damage in the prior art while having the same technical advantages of larger pump and in a pump having a non-clog design and improved costs of manufacture.

Figure 7:
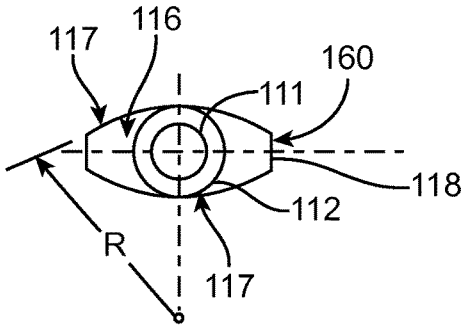
FIG. 7 illustrates a shaft side, top end view of the cutter bar.

As is shown in FIGS. 3, 7 and 9, the outer surface 117 of the cutter bar 102 may be formed curved having a radius R dimensioned to optimize the shearing cutting action 150 between surface(s) 153 of each of the one or more cutter blades 124 and the upper surface 116 of the cutter bar 102. Additional shearing cutting action 150 is provided by adjacent edges and surfaces of cutting ring 121, inner ring 122, outer ring 123, and blades 124 of the axial cutter ring assembly 103 and the cutter bar 102 upper surface 116 as is described herein. The radius R of the cutter bar 102 pushes solids outwardly allowing the shearing cutting action 150 by both the radial cutter ring assembly 101 (i.e. holding solids in slots 128) and the axial cutter ring assembly 103. The radius R of the surface 117 advantageously elongates the cutting line of blade(s) 124, along with the blades 124 being disposed at angle 125, to improve the shearing cutting action 150 and operation of the pump 100. Operation of the pump 100 is specifically improved by allowing solids to be cut initially adjacent inner ring 122 near the center hole 127, with progressive cutting towards the outer ring 123 as well as to balance drive unit 170 in aspects of loading, operation, and performance in the pump 100.

Figure 6:
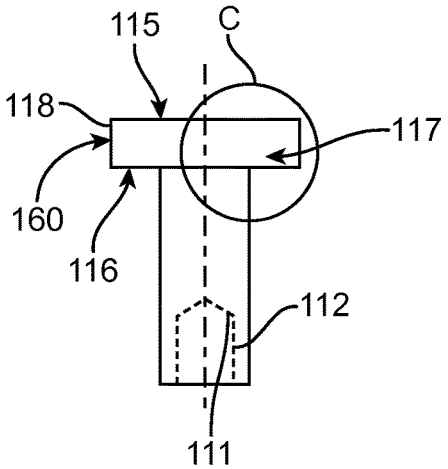
FIG. 6 illustrates a side view of the cutter bar according to an embodiment of the present invention.
Figure 8:
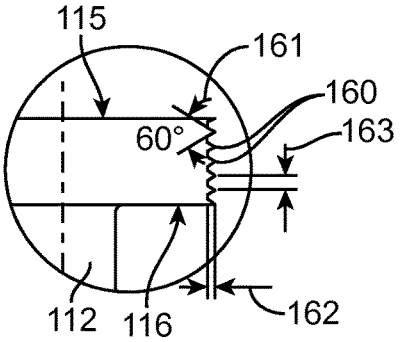
FIG. 8 illustrates side edge view of the grooved cutters on the edge of the cutter bar from circle-detail-view C from FIG. 6.

As is shown in FIGS. 6 and 8, the edge surface 118 of the cutter bar 102 is configured with a cutter blade 160 that may be formed as grooves, serrations or teeth so as to form a plurality of blades that cut solids 145 by the shredding cutting action 140 as the cutter bar 102 rotates against the radial cutter ring assembly 101. The surface 121 and recessed plurality of slots 128 are spaced a predetermined dimension 136 (FIG. 3) apart from the radial cutter ring assembly 101, for example, dimensioned about 0.015 inches therefrom. The cutter blade 160 can be configured to have an optimal shredding cutting action 140, for example, configured to have a tooth angle 161 of about 60 degrees, and a height or depth 162 spacing of about 0.06" inches, and a width 163 spacing of about 0.12" inches.

As is shown in FIGS. 1 and 3, cutting of the solids 130 is performed by multiple cutting actions: (1) a radial cutting portion or surface 141 is formed between the radial cutter ring assembly 101 the cutter blades 160 of the cutter bar 102 to perform the shredding cutting action 140; and (2) the shearing cutting action 150 between the axial cutting surface 153 of the blades 124 of axial cutter ring assembly 103 and the upper surface 116 of the cutter bar 102. These multiple cutting actions can be performed individually and/or simultaneously and are created first by suction created by impeller 109 and solids 130 begin to Flow F into the inlet port 105 as shown in FIG. 1. For illustrating each cutting action, referring to FIG. 3, as solids 145, 155 enter the inlet port 105, the rotation of cutter bar 102 pushes these solids 145, 155 outwardly from the center to the edge. For solids 145 (e.g. woven fibrous materials, etc.), the rotation of the cutter bar 102 forces contact between the cutter blade 160 and the woven fibrous materials held by the slots 128 of the radial cutter ring assembly 101, whereby these woven fibrous materials are cut and shredded sufficient to pass to outlet port 106. For solids 155 suction and deflection at inlet port 105 force to the openings 126 for the shearing cutting action 150, and the gaps or side shear slots 128 in the axial cutter ring assembly 101 hold the solid 155 (e.g. woven fibrous materials, etc.) in an aligned orientation for shearing between the axial cutting surface 153 the blades 124 of the axial cutter ring assembly 103 and upper surface 116 of the cutter bar 102, thereby improving the cutting and processing woven fibrous materials through the pump 100.

The shredding and shearing cutting actions 140, 150 cut solids 145, 155, respectively, to a suitable dimension to be output through outlet port 106. The shredding cutting action 140 is assisted by a curved taper 119 of lower surface 115 of the cutter bar 102 combined with the radius R (FIG. 7) of the outer surface 117 to push solids 145, 155 outwardly during operation and rotation, thereby allowing the cutter blades 160 to cut and shred solids 145 against surface(s) 121 and slot(s) 128 in the stationary radial cutter ring assembly 101. Moreover, the cutter bar 102 interacts with the stationary axial cutter ring assembly 103 to cut solids 155 by the shearing cutting action 150. In this shearing cutting action 140, the cutter bar 102 shears the solid 155 against the stationary axial cutter ring assembly 103 in the shearing cutting action 150 similar to a pair of scissors. Referring to FIG. 1, the cutter bar 102 is dimensioned to have a minimum clearance dimension 132 sufficient to perform the shearing cutting action 150, for example, from about 0.001 to 0.005 with the adjacent of the surface 153 so as to shear solids 155 as these pass through openings 126 against any edge of the radial cutter ring surface 121 including inner ring 122, outer ring 123, and blades 124.

Figure 4:
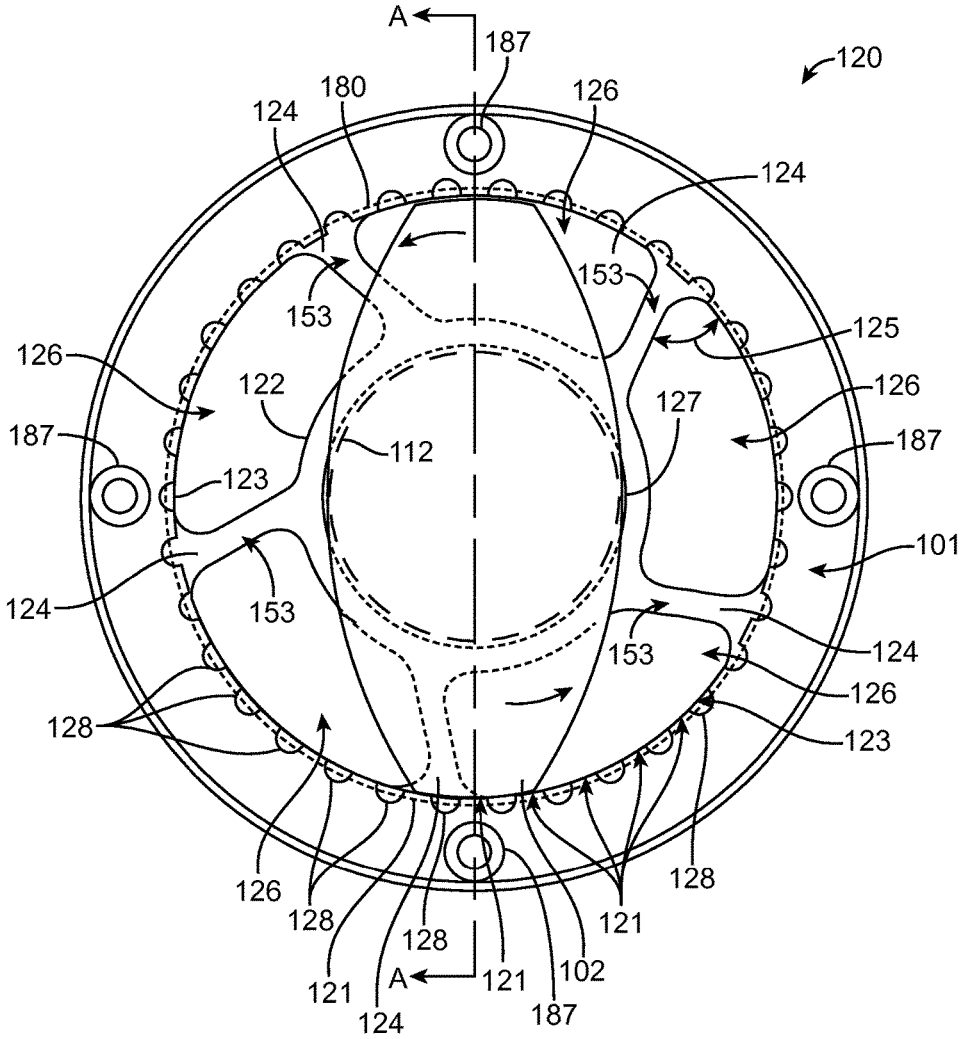
FIG. 4 illustrates a schematic plan view of the cutter bar and axial cutter ring assemblies oriented from the suction side inward towards the impeller according an embodiment of the present invention.
Figure 5:
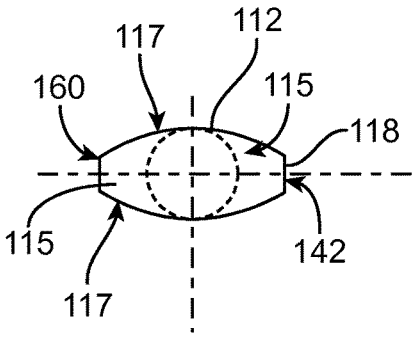
FIG. 5 illustrates a lower surface of the cutter bar according to an embodiment of the present invention.

Referring to FIG. 4, the axial cutter ring assembly 103 can be configured with an inner ring 122, an outer ring 123 connected by one or more blades 124 disposed at an angle 125 thereby creating one or more opening(s) 126. The inner ring 122 is configured with a center hole 127 to accept the bar shaft 112 of the cutter bar 102. The blades 124 are disposed at angle 125 sufficient to cause shearing cutting action 150 so as to cut to solids 145, 155 between the blade 124 and the upper surface 116 of cutter bar 102. For example, when solids transit into the opening 126 the circular rotational motion of the cutter bar 102 begins to cut such solid 155 in a scissor-like action against the particular blade 124 from the inner portion outwardly. The opening(s) 126 are configured with a dimension so as to allow for maximum Flow F performance of the pump and for passage of solids 145 and 155 such as, for example, to provide a larger dimension than inlets of conventional pumps of the same size.

As illustrated in FIG. 4, in order to perform the shredding cutting action 140, the radial cutter ring assembly 101 is configured with a radial cutter ring surface 121 and one or more side shear slots 128 disposed on an inner surface of the radial cutter ring assembly 101 adjacent the edge 118 of the cutter bar 102. The side shear slots 128 function to hold a solid 145, for example, woven fibrous material for the shredding cutting action 140 by the circular, rotational motion of the cutter bar 102, as turned by the drive unit 170 of the pump 100, to pass over and adjacent radial cutter ring surface 121, whereby cutter blades 160 cooperate with surface 121 (e.g. in a counter-clockwise rotation shown in FIG. 3) to cut with solid 145 held within, or there-between, dimension 136 as illustrated in FIG. 3.

The slots 128 also are adapted to hold solids 155 that transit into the opening 126 to assist in the shearing cutting action 150. As illustrated in FIG. 4, the shearing cutting action 150 begins with the coordinated action of upper edge 116 of the cutter bar 102 adjacent blade surface 153 and inner ring 122 along a blade 124 outwardly towards the outer ring 123. The curved outer surface 117 of cutter bar 102 elongates the cutting line and edge of upper surface 116. The curved outer surface 117 advantageously improves pump performance and longevity by balancing the shearing cutting action 150 when cutting solids 145, 155. The shearing cutting action 150 is performed to a smaller degree by any other edges of inner and outer rings 122 and 123, respectively, as discussed herein. For example, modern woven fibrous materials, fabrics and solids 155 (i.e., diapers, wipes, floor mops, tampons, fabrics, etc.) are difficult to process with conventional chopping and/or grinder pump assemblies. Accordingly, in operation of pump 100, when woven fibrous material of the solid 155 is sucked into an opening 126, the solid 155 starts to transit from the inlet port 105 to the outlet port 106. As the cutter bar 102 rotates over the and adjacent surface(s) 153, the shearing cutting action 150 cuts solids 155 between edges of upper surface 116 and leading edge of blades 124. The woven fibrous materials as solid 145 also can be held in one or more respective slot 128 of the radial cutter ring assembly 101 and to assist the shearing cutting action 150 and for cutting and shredding by cutter blades 160.

As shown in FIGS. 3, 4, 10 and 11, slots 128 are adapted to retain solids 145 for the shredding cutting action 140. In this case, the woven fibrous material 145 is held by slots 128 as the cutting blades 160 on edge 118 of cutter bar 102 sweep past radial cutter ring surface 121 with minimum clearance of the predetermined dimension 136 to cut and shred solids 145 by the shredding cutting action 140. Slots 128 further tend to align the fibers of woven fibrous material longitudinally in the slot 128 advantageously for cutting into elongated strands of fibers (e.g. spaghetti-like) to advantageously create a balanced and efficient shredding cutting action 140.

As also is shown in FIGS. 5-10 and 11, the lower surface 115 of the cutter bar further reduces the motor load and improves performance of the pump 100 as it cuts and shears solids 145 by (1) kicking out larger solids from the inlet port 105; and (2) directing Flow F so as to push solids 145, 155 outwardly, for example, so that solids 145 can be held in the slot(s) 128 to be cut and shredded by the cutting blades 160 against radial cutter ring edge 121 as well as so that solids 155 can be cut and sheared by the shearing cutting action 150, as illustrated in FIGS. 1-4, and 10-11.

Referring to FIG. 4, the axial cutter ring assembly 103 can be configured to have one or more blades 124 disposed at a predetermined angle 125. The predetermined angle 125 is selected to sufficiently cut, balance the load, and designed optimize the shearing cutting action 150 such as, for example, the predetermined angle selected as being approximately 50 to 70 degrees according to an embodiment of the present invention, and especially 60 degrees. It is appreciated that other angles can be used that provide suitable shearing cutting action 150 of the blade 124 depending on factors such as the power and speed of rotation of the drive unit 170. The one or more blades 124 may be formed from a variety of suitable materials used to make a blade, knife or other simple, cutting edges for machine and/or edged hand tools including carbon steel, stainless steel, tool steel and alloy steel, for example, 5160 spring steel as well as less common materials such as cobalt and titanium alloys, ceramics, obsidian, and plastic.

In the operation of the shredding cutting action 140, material held by slots 128 can be cut and shredded by the rotating action of the cutter bar 102, as illustrated in FIGS. 3-4. In this action, any solids 145 momentarily retained by slots 128 are cut and shredded by the cutter blade 160 on edge 118 of the cutter bar 102 against the radial cutter ring surface 121 of the stationary radial cutter ring assembly 101. The shredding cutting action 140 can occur several times depending on the pump Flow F and the rotational speed of the pump shaft 113. The remaining solids further progress to the point of beginning to exit through the axial cutter ring assembly 103, which will begin the operation of the shearing cutting action 150, as the solids Flow F past the cutter bar 102 into the opening 126, the cutter bar 102 sweeps past and cuts the material against the blade 124. The shearing cutting action 150 occurs from the interior portion adjacent the inner ring 122 to the outside ring 123 along the blades 124 on each side of the cutter bar 102, whereby solids 155 are cut initially by the cutting edge the inner ring 122 near the center 127, with subsequent progressive cutting outwardly to the outer ring 123 along each blade 124 due to motor rotation and the spinning action of the cutter bar 102. The shearing cutting action 150 is advantageous to help balance the load requirement and improve the shearing ability of the blades 124 and cutter bar 116.

Moreover in further operation, as illustrated in FIGS. 3-4, solids 145, 155 that are too large to pass through the inlet port 105 are ejected or kicked out by the cutter bar 102 using its rounded edge of lower surface 115 until the size has been reduce for retention in opening 126. The cutter bar 102 essentially ejects larger solids 155 and/or materials 155 during operation, and then the suction and Flow F draws these solids 155 and/or materials 155 back into contact with the cutter bar 102 again. Larger solids eventually reduce to a dimension that can pass through the pump 100 after repeated shredding and shearing cutting actions 140, 150, respectively, using the rotation of the cutter bar 102 to cut solids 145, 155 into smaller pieces.

In this way, the design of the present invention prevents clogging of the pump 100. The design allows the pump 100 to continue operation while further reduction of larger solids 145, 155 is occurring during operation. Such an ongoing reduction of larger solids 145, 155 during operation advantageously allows the pump to regulate the amount of solids flowing into the pump 100 at any point in time. This regulation feature of the pump 100 design also advantageously allows for normal start and stop cycles in a centrifugal, consumption pump that will continue to allow Flow F through the pump 100 even if a large solid is present at the intake 105, and, during this event, the pump 100 will continue to work on reduction of the solids 145, 155 without placing an excessive load on the pump 100.

Another advantage of the design of pump 100, according to an embodiment of the present invention, is a combination of shredding and shearing cutting actions 140, 150 to improve cutting, shearing, and shredding of solid materials 145, 155, especially woven fibrous materials. As illustrated in FIGS. 1 through 11, the shredding cutting action 140 utilizes the rotating cutter bar 102 to interact with the stationary radial cutter ring assembly 101 to perform an initial shredding of solids 145. Another advantage of the design of pump 100 is in the adjustability of the housing 107 and/or cutter assembly 180 the configuration to allow for wear of parts. The pump 100 is configured with the cutting assembly 180 and cutter housing 107 adapted to receive and secure the axial cutter ring assembly 103, radial cutter ring assembly 101 to the housing 107, whereby the threaded connection 108 of the housing 107 and the pump casing 104 allows for adjustments relative to the cutter bar 102 and suction plate 120 by rotating the treaded connection 108 and securing by a locking fastener or set screw 129, whereby such adjustment can be performed easily and quickly and to these components in the field. The adjustability feature of the present invention allows for an accurate adjustment for optimum shearing when new, as well as an adjustment(s) for wear over time.

As illustrated in FIGS. 1 through 11, the improved design allows for right-sizing the pump to the application. Referring to FIG. 11, a centrifugal pump 100 includes a drive unit 170 (e.g. a motor) generally disposed vertically. The motor 170 includes windings 171 and a stator 172 formed around the drive shaft 113 so that when energized in a known way turns or otherwise rotates the drive shaft 113. The drive unit 170 is disposed within the pump casing 104. The drive shaft 113 is supported by one or more shaft bearings 173 for optimum operation and to maintain in alignment and has one or more seals 174 in order to isolate the drive unit 170 and shaft 113 from environmental factors and conditions (i.e. water, submersion, dust, etc.). The impeller 109 can include one or more bearings 175 for optimum operation and to maintain in alignment. In some applications, the pump 100 is disposed on stand 114 in an open configuration such as, for example, when disposed in a tank for a wastewater application. However, it is to be appreciated that the pump 100 intake 105 can be secured to a pipe in a closed configuration with output 106 connecting to an outflow pipe.

The construction of pump 100 in a wastewater application can be in a smaller dimension, whereby the practice of over-sizing the pump simply for a larger intake 105 and diameter 181 (FIG. 2) for accepting large solid materials that flow unimpeded in larger pumps. Accordingly, over-sizing the pump 100 would become unnecessary, thereby saving costs and improving efficiency. Applications for right-sizing the pump 100 to operate on solids 145, 155 include municipal and industrial wastewater, sewage, and other pumping operations where the debris contained in the water may prevent the smooth discharge of sewage. Moreover, in downstream applications smaller pumps are ideal, for example, where these products enter the liquid stream such as an individual home, hotel, condo, subdivision, trailer park, etc. or in industrial applications.

Smaller pumps are needed in applications of homes, trailer parks, public toilets, so as to handle soft, high-tensile strength materials like diapers, wet wipes, rags, and towels of modem wastewater. When smaller conventional centrifugal pumps are used problems occur because of clogging the smaller suction inlet, the inability to cut these fibrous materials, fibrous materials wrapping around the impeller and other complications. Also conventional pumps are not used as the strands of fibrous materials and solids are not easily cut cleanly resulting in wrapping and clogging the impeller operation, thereby causing pump failure. For example, the impeller of a centrifugal pump creates the suction through the intake plate and impeller can become clogged by large solids or fibrous materials. Current smaller dimension pumps also do not have the ability to shred and provide passage of soft, high-tensile strength materials, while still maintaining optimum pump performance when handling normal sewage to avoid a clogged pump, and thereby increasing the capacity of sewage pump-containing debris in the water, which has been a long-felt need in the art.

While certain configurations of structures have been illustrated for the purposes of presenting the basic structures of the present invention, one of ordinary skill in the art will appreciate that other variations are possible which would still fall within the scope of the appended claims. Additional advantages and modifications will readily occur to those skilled in the art. For example, the axial cutter ring assembly 103 can use different materials for the blades 124 and for the inner and outer rings 122, 123 so as to improve the wear of the assembly. Similarly, the upper surface 116 of the cutter bar 102 can use a different material so as to improve the wear. The pump 100 also can be used in other applications such as, for example, to industrial applications where the shear and shred cutting actions are advantageous to the wastewater being pumped. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A pump, comprising:

a pump casing having an inlet and an outlet formed therein;

a drive unit with a drive shaft extending axially through said pump casing;

an impeller connected to said drive shaft and positioned within said pump casing, said impeller having a plurality of vanes configured to direct liquid radially towards said outlet;

a radial cutter ring assembly positioned adjacent said inlet of said pump casing and said impeller, said radial cutter ring assembly configured with a plurality of side shear slots arranged on radial cutter ring surface of said radial cutter ring assembly;

a cutter bar connected to said drive shaft, said cutter bar configured with one or more cutting blades located on an edge disposed adjacent said radial cutter ring surface and an upper surface substantially planar;

an axial cutter ring assembly configured to provide a shredding cutting action of the solid performed by said cutting blades rotating past said radial cutter ring surface of said radial cutter ring assembly, said axial cutter ring assembly comprising an outer ring and an inner ring connected by one or more blades forming openings between said outer and inner rings adapted for the passage of solids from the inlet to the outlet, said axial cutter ring assembly having a surface disposed substantially parallel to said upper surface of said cutter bar, said axial cutter ring assembly disposed between said impeller and each of said radial cutter ring assembly said cutter bar, said axial cutter ring assembly; and a housing having means for adjusting a predetermined dimension between said surface disposed substantially parallel to said upper surface of said cutter bar so as to adjust a shearing cutting action of the solid performed by edges of an upper surface of said cutter bar and a surface of one or more blades of said axial cutter ring assembly sliding past one another.

2. The pump of claim 1 wherein side shear slots of said radial cutter ring assembly being configured to hold solids for said shredding cutting action by said cutter bar as said cutting blade passes said radial cutter ring surface.

3. The pump of claim 1 wherein said cutter bar is configured with a rounded surface located on the suction side of the cutter bar adapted to eject solids of a predetermined dimension larger than said openings in said axial cutter ring assembly.

4. The pump of claim 1 wherein said blades of said axial cutter ring assembly are disposed at an angle sufficient to cut solids of a predetermined dimension entering said openings in said axial cutter ring assembly by said shearing cutting action.

5. The pump of claim 1 wherein said housing being configured to adjust a predetermined dimension between said surface disposed substantially parallel to said upper surface of said cutter bar to allow for optimizing shearing cutting action between said upper surface of said cutter bar and said one or more blades when new and after some wear has occurred.

6. The centrifugal pump of claim 1 wherein said cutting blades on said edge of said cutter bar are formed from the group of blades, grooves, serrations or teeth.

7. The centrifugal pump of claim 1 wherein said one or more blades forming openings of said axial cutter ring assembly being configured to sufficiently optimize fluid flow, thereby allow the pump to perform the function of a non-clog wastewater pump.

8. A cutter assembly for an inlet port of a pump casing adjacent an impeller of a pump, comprising:

a housing formed in a generally cylindrical shape, said housing configured with a predetermined diameter, a side wall and open ends, said side wall further comprising a cutter flange located at one end extending inwardly from said side wall and a connecting flange at an opposite end extending outwardly from the side wall, said cutter and connecting flanges being adapted with one or more attachment points for one or more fasteners, and said side wall having a generally smooth inner surface and a threaded outer surface between said cutter and connecting flanges so as to be received by a treaded portion of said inlet port of said pump casing;

an axial cutter ring assembly configured to be received in said housing and secured to said housing, said axial cutter ring assembly being located adjacent said cutter flange, said axial cutter ring assembly configured with an outer ring and an inner ring connected by one or more blades forming openings between said outer and inner rings adapted for the passage of solids from the inlet port to the outlet port; and a radial cutter ring assembly configured to be received in said housing and secured to said attachment points by said one or more fasteners positioned adjacent said inlet port of said pump casing, said radial cutter ring assembly configured in a ring with one or more side shear slots arranged on an inner surface of said ring.

9. The cutter assembly of claim 8 wherein said housing is adjustable using said threaded portion of said inlet port so as to adjust a shearing cutting action performed by rotation of a cutter bar connected to a drive shaft of the pump across an axial cutting surface formed by a upper surface of said cutter bar and a surface of one or more blades of said axial cutter ring assembly sliding past one another.

10. The cutter assembly of claim 8 further comprising at least one locking fastener in said connecting flange of the housing, said locking fastener configured to set the position of the housing relative to the pump casing and said cutter bar after rotating by said threaded portion.

* * * * *